US008826626B2

(12) United States Patent
Hertz

(10) Patent No.: US 8,826,626 B2
(45) Date of Patent: Sep. 9, 2014

(54) LIGHT-WEIGHT LOAD-BEARING STRUCTURES

(75) Inventor: Kristian Hertz, Brønshøj (DK)

(73) Assignee: Abeo A/S, Frederiksberg (DK)

( * ) Notice: Subject to any disclaimer, the term of this patent is extended or adjusted under 35 U.S.C. 154(b) by 591 days.

(21) Appl. No.: 12/744,416

(22) PCT Filed: Nov. 21, 2008

(86) PCT No.: PCT/EP2008/066013
§ 371 (c)(1),
(2), (4) Date: Aug. 20, 2010

(87) PCT Pub. No.: WO2009/068483
PCT Pub. Date: Jun. 4, 2009

(65) Prior Publication Data

US 2010/0313505 A1 Dec. 16, 2010

Related U.S. Application Data

(60) Provisional application No. 61/004,278, filed on Nov. 26, 2007.

(30) Foreign Application Priority Data

Nov. 26, 2007 (EP) ..... 07388085

(51) Int. Cl.

| | |
|---|---|
| ***E04C 5/08*** | (2006.01) |
| ***B28B 1/00*** | (2006.01) |
| ***E04C 3/20*** | (2006.01) |
| ***E04C 2/04*** | (2006.01) |
| ***B28B 19/00*** | (2006.01) |
| ***E04C 2/06*** | (2006.01) |

(52) U.S. Cl.
CPC . *E04C 3/20* (2013.01); *B28B 1/008* (2013.01); *E04C 2/044* (2013.01); *B28B 19/00* (2013.01); *E04C 2/06* (2013.01)
USPC ..... 52/742.14; 52/223.6

(58) Field of Classification Search
USPC ..... 52/223.6, 223.8, 223.1
See application file for complete search history.

(56) References Cited

U.S. PATENT DOCUMENTS 2,826,788 A * 3/1958 Graham ..... 280/751
3,334,458 A * 8/1967 Leemhuis ..... 52/223.6

(Continued)

FOREIGN PATENT DOCUMENTS

AT 344 966 B 8/1978
DE 23 37 728 A1 2/1975

(Continued)

OTHER PUBLICATIONS

Form PCT/ISA/210, Feb. 25, 2009, ISR for PCT/EP2008/066013.

(Continued)

*Primary Examiner* — Mark Wendell
(74) *Attorney, Agent, or Firm* — McDermott Will & Emery LLP

(57) ABSTRACT

The invention relates to a light-weight load-bearing structure (1) with optimized compression zone (2), where along one or more compression zones (2) in the structure (1) to be cast a core (3) of strong concrete is provided, which core (3) is surrounded by concrete of less strength (4) compared to the core (3) of strong concrete. The invention also relates to a method of casting of light-weight load-bearing structures (1) with optimized compression zone (2) where one or more channels, grooves, ducts, pipes and/or hoses (5) formed in the load-bearing structure (1) serves as molds for molding one or more cores (3) of strong concrete in the light-weight load-bearing structure (1).

13 Claims, 4 Drawing Sheets

(56) References Cited

U.S. PATENT DOCUMENTS

Figure 1:
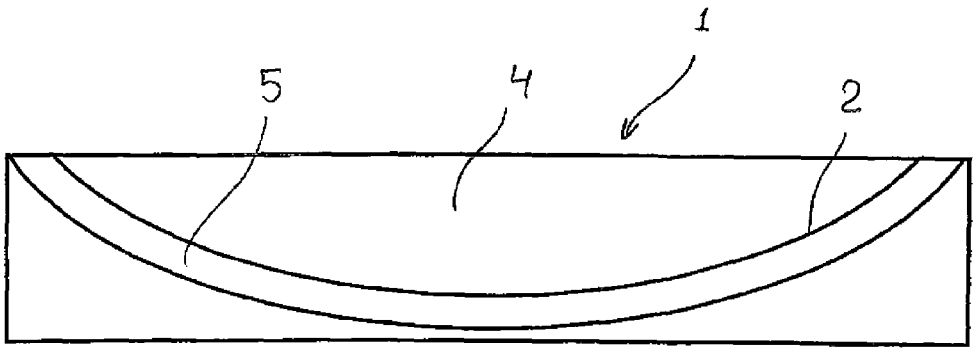

| | | | | |
|---|---|---|---|---|
| 4,030,265 | A * | 6/1977 | Allgood | 52/600 |
| 4,831,800 | A * | 5/1989 | Nedelcu | 52/223.12 |
| 4,999,959 | A * | 3/1991 | Virtanen | 52/223.14 |
| 6,226,944 | B1 * | 5/2001 | Peshkam et al. | 52/309.8 |
| 6,240,686 | B1 * | 6/2001 | Mill | 52/223.1 |
| 7,765,755 | B2 * | 8/2010 | Williams | 52/309.9 |
| 2011/0146170 | A1 * | 6/2011 | Hertz | 52/223.14 |

FOREIGN PATENT DOCUMENTS

| | | | |
|---|---|---|---|
| WO | 88/08907 | A1 | 11/1988 |
| WO | 2005/066419 | A1 | 7/2005 |

OTHER PUBLICATIONS

Form PCT/IPEA/409, Dec. 22, 2009, IPRP for PCT/EP2008/066013.

* cited by examiner

LIGHT-WEIGHT LOAD-BEARING STRUCTURES

This application is the U.S. national phase, pursuant to 35 U.S.C. §371, of PCT international application Ser. No. PCT/EP2008/066013, filed Nov. 21, 2008, designating the United States and published in English on Jun. 4, 2009 as publication WO 2009/068483 A1, which claims priority to European application Ser. No. 07388085.8, filed Nov. 26, 2007 and the U.S. application Ser. No. 61/004,278, filed Nov. 26, 2007. The entire contents of the aforementioned patent applications are incorporated herein by this reference.

The invention relates to light-weight load-bearing structures.

The invention further relates to a method of casting of light-weight load-bearing structures.

Previously, minimal structures have been applied for large bridges, but they have proved to be expensive and therefore impossible as real minimum structures for medium sized and small structures as found in buildings and halls.

Different solutions to create building structures of high strength and low weight have been tried over time.

One well known method is to reinforce concrete by applying rods, wires or profiles of steel to take tension and shear in reinforced concrete structures Another method is to combine hot rolled steel profiles and concrete into composite structures or to make "sandwich slabs" with steel reinforcement in the tension layers or with steel plates as the tension layers.

These methods deal with applying reinforcing bars or profiles for the tension zones in elements of reinforced concrete.

However, the profiles are straight or plane and none of these methods allow an optimal design of the compression zones.

It is also possible to use high-strength concrete. But compressed cross sections of high-strength concrete have to be large and therefore heavy in order to be stable.

A pillar of high-strength concrete will have a tendency to deflect or buckle to the sides when pressure is applied to the ends of the pillar unless the cross section of the pillar is rather large.

When such a pillar is compressed by applying pressure on the ends, movement of the pillar in a direction crosswise of the longitudinal direction of the pillar will occur. If the crosswise movement of such a pillar increases it will have impact on the stability of the pillar.

Another drawback to the use of high-strength concrete is the tendency to spall at temperatures reaching 374° C.

Further minimal structures are applied for bridges with compression arches made by expensive moulds following the moment curves and to which the load is applied by tension bars under the arch or columns above it.

Prestressed concrete structures are applied to for example TT beams for large spans in prefabricated halls for industry and commerce. These beams are not optimal. Super Light Structures may improve the performance considerably with regard to dimensioning the structure and the length of the free span of the load-bearing structure.

Prestressed concrete structures are applied, where the path of the prestressing cables follow the variation of the load. Here the tension zone is optimized, but the compression zone is not. The compression zone is reduced by application of the prestress, which means that the entire cross-section is compressed and therefore not cracked and therefore contributes to the stiffness and stabilisation. But still the compression zone is stabilizing itself. In the invention the stability is provided by the light material surrounding the compression zone and further the compression zone is hereby protected by the light material.

These drawbacks are eliminated by a light-weight load-bearing structure with optimized compression zone according to the invention.

The invention makes it possible to cast a light load-bearing structure with an optimized shape of the compression zone.

This is obtained by rethinking the load-bearing structure as a strong skeleton included in a soft material where the skeleton placed in one or more compression zones comprises a material of suitable compressive strength such as a high-strength concrete and further achieved by the invention by having a core of strong concrete provided along one or more compression zones, in the structure to be cast, which core is surrounded by concrete of less strength compared to that of the core.

In an embodiment of a light-weight load-bearing structure one or more cast compression zones with cores of strong concrete in compression zones are combined with reinforcement in tension zones.

Further the reinforcement in tension zones can be provided by suitable parts such as ropes, wires, plates, meshes, fibres, fabrics, rods or bars of suitable materials such as steel, carbon fibres, glass, polypropylene fibres or products of plastic, metals or organic fibres In a further embodiment compression zones are joined within the structure to form an even stronger and/or lighter structure.

Hereby it is possible to combine one or more compression zones and one or more tension zones to form a lattice or a load-bearing part of a structural member.

It is further possible to join the compression zones with compression zones in other structural members including tension zones.

In another embodiment one or more compression zones are provided with a cross section, which cross section increases towards points where forces are exchanged with other compression or tension zones.

Hereby is achieved an expedient embodiment of a core forming the compression zone and expedient transitions between compression zones (reducing the contact stresses), compression and tension zones (improving the anchorage) or between such zones in structural members or parts being joined.

In further an embodiment one or more compression zones are provided with a cross section increasing towards at least one end.

In a further embodiment the increased cross sections of the compression zones, for example the ends, are joined in joints or segments.

The load-bearing structure can be manufactured by forming a kind of channel, groove, duct or the like or using a pipe, hose or the like as a mould.

A channel, groove, duct, pipe, hose or the like can be placed in a mould for a load-bearing structure, The channel, groove, duct, pipe, hose or the like is placed where it is desired to concentrate compression, for example in a compression arch.

The mould is thereafter cast out with a light material which for example can be light aggregate concrete. Then the compression zone is cast out with a stronger concrete, for example a self-compacting high-strength concrete.

Strong concrete is any concrete stronger than the light material and it can be obtained in several different ways, and the invention is not limited to a single method of obtaining strong concrete. As an example, a concrete of high strength may be applied, and it could be obtained by adding fine-grained particles to the concrete. Further, it is possible to apply additives to the strong concrete and/or to the light material, among which superplastifying additives or materials may be used to obtain high-strength properties and/or improved workability such as self-compacting properties By casting out the compression zones, it is possible to give them optimal shapes and layouts following the actual shape of force trajectories, and it is possible to stabilise compression zones for deflection and buckling, so that they do not need to be larger than necessary for the cross section to resist the load without being increased in order to ensure the flexural stiffness.

This is further achieved by the invention by a method of casting of light-weight load-bearing structures with optimized compression zone where one or more channels, grooves, ducts, pipes and/or hoses formed in the load-bearing structure serves as moulds for moulding one or more cores of strong concrete in the light-weight load-bearing structure.

In another method of casting of light-weight load-bearing structures with optimized compression zone where a mould is provided for moulding a core of strong concrete along one or more compression zones in the structure to be cast, which core afterwards is surrounded by concrete of less strength compared to the core of strong concrete.

In another embodiment of the invention the compression zones formed of the strong concrete can be cast out in a mould and later transported to the construction site, where the larger load-bearing structure is to be produced. At the site the strong concrete member or members are placed in a mould and thereafter the load-bearing structure is produced and cast out with light material whereby the strong concrete member or members are completely or partly surrounded by light material.

The invention makes it possible to give the structure an external shape supporting the applications or building structures, so that the load can be applied, and give the possibility that the structure can be included in roofs and walls.

The invention makes it possible to protect the compression zones against mechanical impacts.

The invention makes it possible to protect the compression zones against fire. Fire is especially a problem for high-strength concrete, because the risk of explosive spalling and a number of severe damages have been seen due to spalling structures made of high-strength concrete. The spalling is a major hindrance for the application of high-strength concrete today. The invention may use ordinary porous concrete instead, but high-strength concrete will be beneficial, and the investigation solves the spalling problem by ensuring that the concrete is not heated above the critical temperature for water 374° C., where spalling problems occur. This is achieved by having the high-strength concrete embedded in the light concrete of the light-weight load-bearing structure, where the light material provides a heat isolating effect to the load-bearing structure.

In an embodiment of the invention a channel, hose, duct, pipe, or groove is placed in a mould for a load-bearing structure to concentrate compression, for example in a compression arch. The mould is cast out with a light material for example light aggregate concrete. Then the compression zone is cast out with a material of a suitable compressive strength for example a self-compacting high-strength concrete.

Hereby is achieved that the quantity of strong and often heavy materials for compression zones can be minimized, because the light material can contribute:

- to make it possible to give compression zones optimal shapes and layouts,
- to stabilise compression zones for deflection and buckling,
- to combine compression zones with other parts incl. tension zones if any,
- to give the structure an external shape supporting the applications,
- to protect compression zones against mechanical impacts, and
- to protect compression zones against fire.

Materials for compression zones are often 3-5 times heavier and 3-10 times stronger than the light materials. The application of the principle therefore makes it possible to create structures, which are 2-4 times lighter than traditional cast structures.

This enables large spans and column distances.

Minimal structures, where the positions of compression and tension zones are optimised in relation to the load, has until now been difficult and often impossible to make, because the function requirements mentioned can not be fulfilled in practise in particular for small and medium sized structures.

This technology can make minimal structures applicable for buildings.

This technology can make high-strength concrete applicable for buildings.

The technology can also make high-strength concrete applicable for floating structures such as ships, barges, offshore structures and floating foundations which are known as special applications for concrete and prestressed concrete structures. Light-weight load-bearing structures with optimized shapes of the compression zones according to the invention may improve the design of such structures facilitating production, saving resources for manufacturing and operation and improving performance of the structures.

In an other embodiment of the invention the compression zones represented by the cast out zones of strong concrete can be provided with a larger cross section at the points joining other compression or tension zones or establishing joints or segments.

In combination with one or more of the aforementioned embodiments it is possible to add different elements to the light concrete and/or to the strong concrete to obtain a suitable texture for casting or to obtain a kind of tensile reinforcement.

Such elements can be ropes, wires, plates, meshes, fibres, fabrics, rods or bars of suitable materials such as steel, carbon fibres, glass, polypropylene fibres, stone-wool fibres, or products of plastic, metals, ceramics, chinaware, glass, rock, or organic fibres.

It is obvious that other suitable materials can be used and the invention is not limited to the use of the elements mentioned above.

Figuratively speaking it is possible to compare the invention to the human or an animal body, where the strong concrete provides a kind of skeleton compared to the skeleton of humans or animals, and the light-weight load-bearing structure and the tension reinforcement if any is the muscles and sinews holding the "skeleton" in place providing an optimized and elegant building structure.

Figure 2:
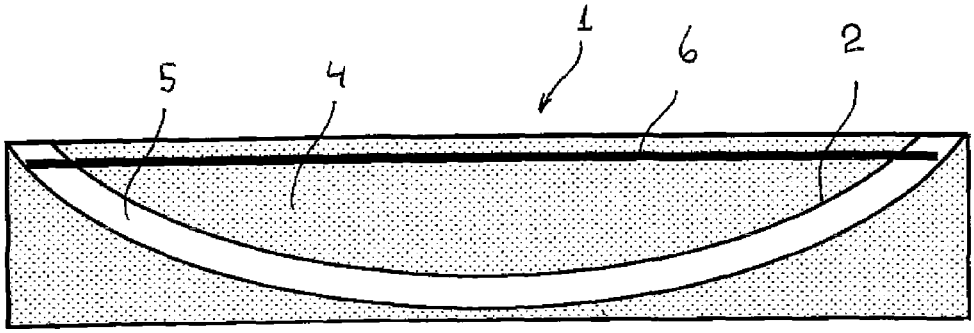
Figure 3:
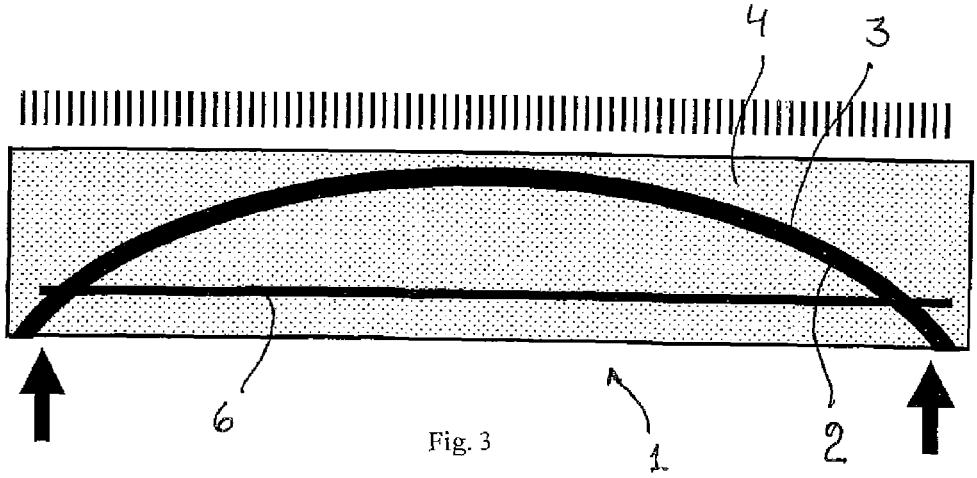
Figure 4:
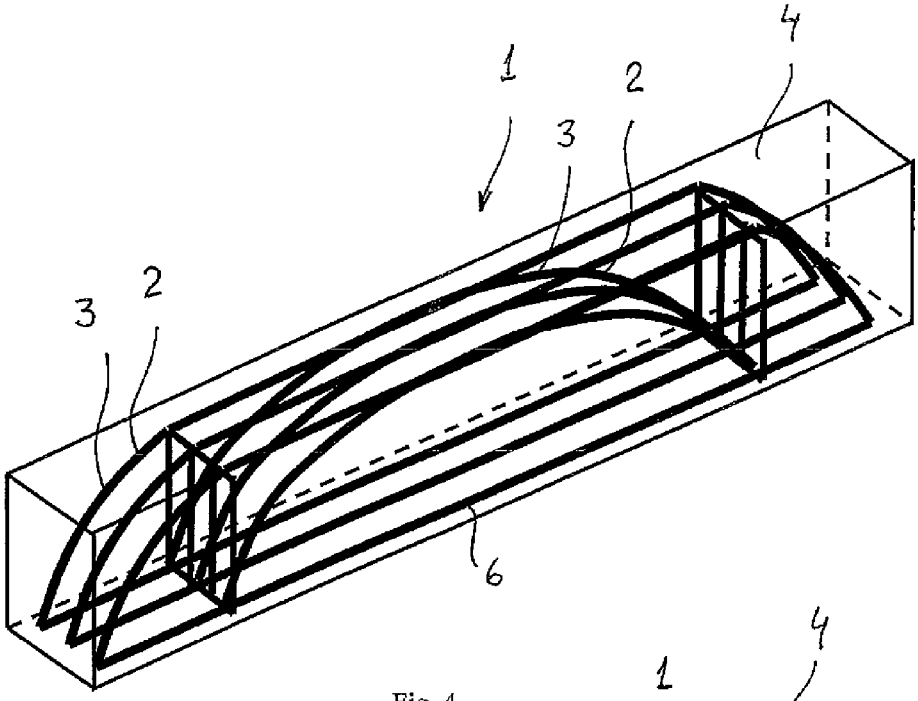
Figure 5:
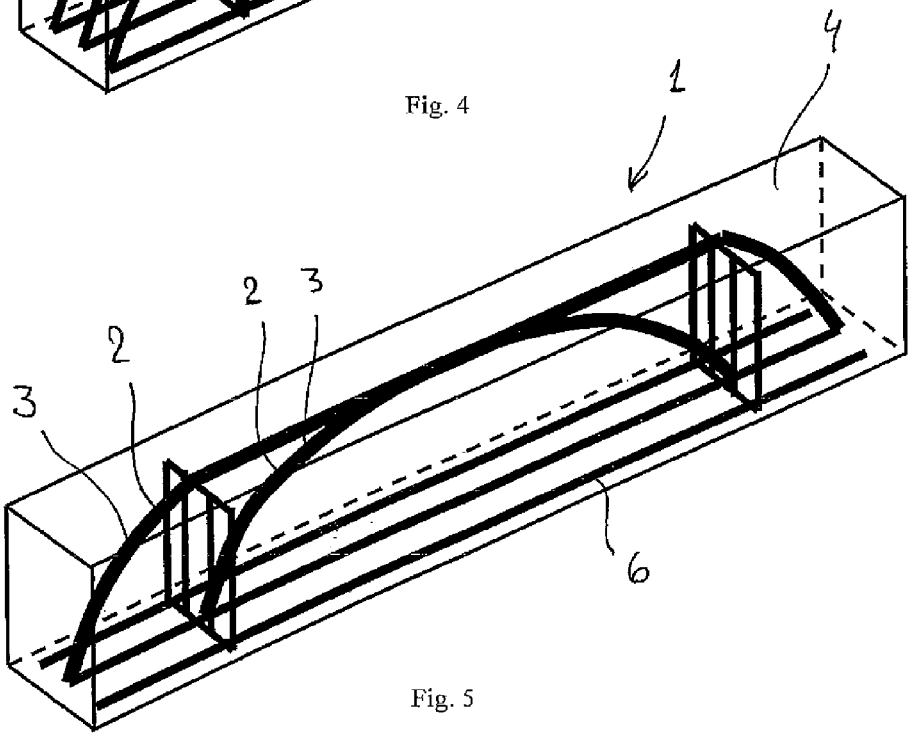
Figure 6:
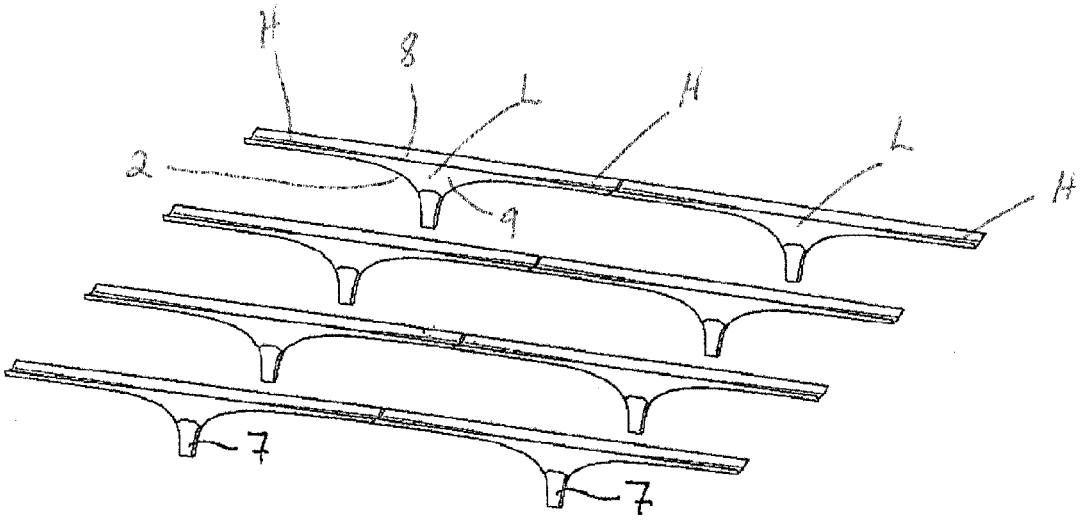
Figure 7:
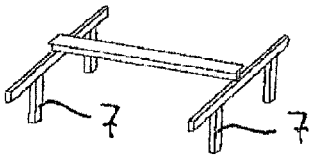

In the following embodiments of the invention will be described with reference to the drawings, where:

FIG. 1 shows a mould for a simple beam with duct for casting a compression zone as a compression arch, FIG. 2 shows a simple lightweight concrete beam with tension reinforcement and duct for casting a compression zone as a compression arch, FIG. 3 shows a simple lightweight concrete beam with tension reinforcement and cast compression zone of strong concrete as a compression arch, where the beam is loaded with uniformly distributed load and reactions, FIG. 4 shows a beam with more cast compression arches stirrups and tensile reinforcement, FIG. 5 shows a beam with a concentrated central cast compression arch and stirrups and tension reinforcement, FIG. 6 shows an example of a layout of a hall with beams spanning 60 m between columns, FIG. 7 shows present day elements giving a maximum span width of 30 m shown in same scale as FIG. 6

Figure 8:
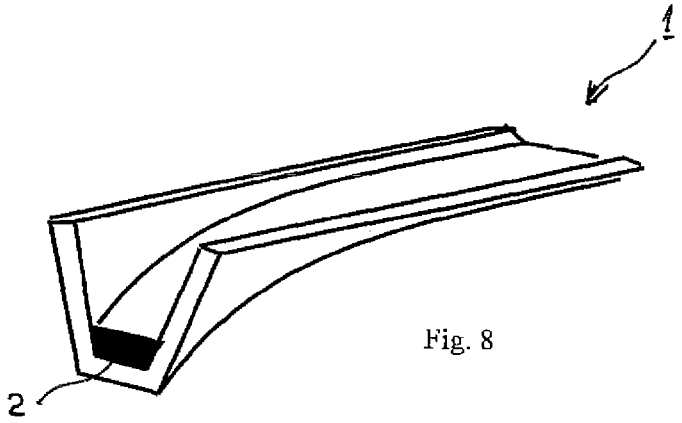
Figure 9:
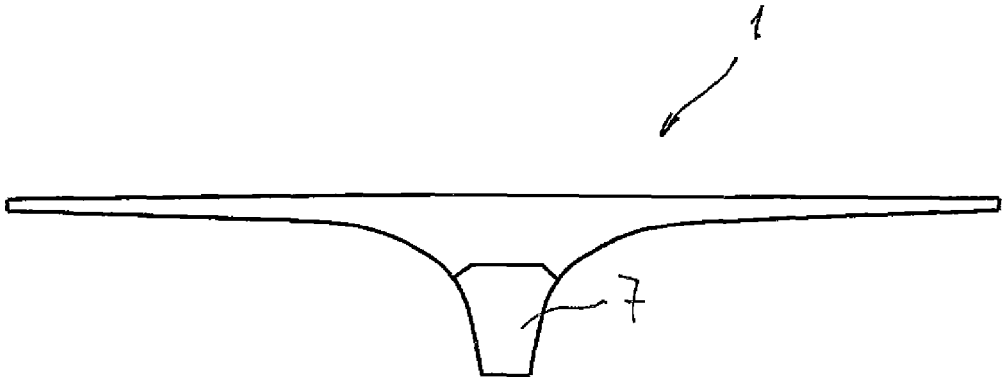

FIG. 8 shows a possible shape of a beam according to an embodiment of the invention with a cast strong compression arch in a groove, and FIG. 9 shows a possible outer shape of a cantilevered beam, according to an embodiment of the invention, with cast compression arches in grooves supported by a column with two cast compression arches in ducts.

Hereafter different embodiments of the invention are described in detail. Light-weight load-bearing structures 1 are elements in the construction industry and by optimizing a compression zone 2 in the load-bearing structure 1 it is possible to produce a light-weight load-bearing structure 1 with a large span.

By manufacturing a light-weight load-bearing structure 1 according to one of the methods of casting compression zones 2 it is possible to provide a light-weight load-bearing structure 1 with optimized compression zone 2 according to the invention.

The invention makes it possible to cast a light load-bearing structure 1 with an optimized shape of the compression zone 2, where the cast out shape of a kind of skeleton is formed to follow natural shape of force trajectories in the structure.

This is obtained by rethinking the load-bearing structure 1 as a strong skeleton included in a soft material where the skeleton placed in one or more compression zones comprises a material of suitable compressive strength such as a high-strength concrete and further achieved by having a core 3 of strong concrete provided along one or more compression zones 2, in the structure 1 to be cast, which core 2 is surrounded by concrete of less strength 4 compared to that of the core 3.

The load-bearing structure 1 can be manufactured by forming a kind of channel, groove, duct or the like 5 or using a pipe, hose or the like as a mould.

A channel, groove, duct, pipe, hose or the like 5 can be placed in a mould for a load-bearing structure.

The channel, groove, duct, pipe, hose or the like 5 is placed where it is desired to concentrate compression, for example in a compression arch 2.

The mould is thereafter cast out with a light material which for example can be light aggregate concrete. Then the compression zone 2 is cast out with a stronger concrete, for example a self-compacting high-strength concrete.

Hereby it is possible to give compression zones 2 optimal shapes and layouts following the actual shape of force trajectories, and it is possible to stabilise compression zones 2 for deflection and buckling, so that they do not need to be larger than necessary for the cross section to resist the load without being increased in order to ensure the flexural stiffness.

This is further achieved by the invention by a method of casting of light-weight load-bearing structures 1 with optimized compression zone 2 where one or more channels, grooves, ducts, pipes and/or hoses 5 formed in the load-bearing structure 1 serves as moulds for moulding one or more cores 3 of strong concrete in the light-weight load-bearing structure 1.

In another method of casting of light-weight load-bearing structures 1 with optimized compression zone 2 where a mould is provided for moulding a core 3 of strong concrete along one or more compression zones 2 in the structure 1 to be cast, which core 3 afterwards is surrounded by concrete of less strength 4 compared to the core 3 of strong concrete.

In another embodiment of the invention the compression zones 2 formed of the strong concrete cores 3 can be cast out in a mould and later transported to the construction site, where the larger load-bearing structure 1 is to be produced. At the site the strong concrete member or members 3 are placed in a mould and thereafter the load-bearing structure 1 is produced and cast out with light material 4 whereby the strong concrete member or members 3 are completely or partly surrounded by light material 4.

In another embodiment of the invention the strong concrete in compression zones 2 are combined with reinforcement in tension zones 6.

In a further embodiment of the invention the reinforcement in tension zones 6 may be provided by for example ropes, wires, plates, meshes, fibres, fabrics, rods or bars of suitable materials such as for example steel, carbon fibres, glass, polypropylene fibres or products of plastic, metals or organic fibres.

In further embodiments of the invention it is possible to combine compression zones 2 with compression zones 2 in other parts and possibly also including tension zones 6 if any to combine one or more compression zones 2 and one or more tension zones 6 to form a lattice or a load-bearing part of a structural member.

In further embodiments of the invention it is possible to combine compression or tension zones 2, 6 with compression or tension zones 2, 6 in other structural members by means of joints.

In another embodiment of the invention one or more compression zones 2 are provided with a cross section, which cross section increases towards the ends or where forces are exchanged between compression zones 2 or between compression and tension zones 2, 6. Hereby is achieved an expedient embodiment of a core 3 forming the compression zone 2 and expedient transitions between compression zones 2 (reducing the contact stresses), compression and tension zones 2, 6 (improving the anchorage) or between such zones in structural members or parts being joined.

In another embodiment of the invention ends of the compression zones 2 are joined in joints or segments.

The invention makes it possible to give the structure 1 an external shape supporting the applications or building structures, so that the load can be applied, and give the possibility that the structure 1 can be included in roofs and walls.

In an embodiment of the invention a channel, hose, duct, pipe, or groove 5 is placed in a mould for a load-bearing structure 1 to concentrate compression, for example in a compression arch 2. The mould is cast out with a light material 4 for example light aggregate concrete. Then the compression zone 2 is cast out with a material of a suitable compressive strength for example a self-compacting high-strength concrete.

Since materials for compression zones 2 are often 3-5 times heavier and 3-10 times stronger than the light materials 4. The application of the principle therefore makes it possible to create structures 1, which are 2-4 times lighter than traditional cast structures.

This enables large spans and column 7 distances.

FIG. 6 shows an example of a structure with large span and thereby long distances between columns 7 compared to the structure shown in FIG. 7, which structure of state of the art here shows a span of half the length of the span obtained by the light-weight load-bearing structure 1 according to one or more of the embodiments of the invention. FIG. 6 also illustrates a light-weight load-bearing structure that may be included in building roofs. In this embodiment, the upper concrete part 8 is cast from higher strength concrete and is positioned on top of the lower concrete part 9, which is cast of less strong concrete. The upper concrete part 8 includes portions defining highs H with lows L between the high H. Compression arches 2 are formed by having a cross section increasing from the highs H to the lows L.

In an other embodiment of the invention the compression zones 2 represented by the cast out zones of strong concrete 3 can be provided with a larger cross section at the points joining other compression or tension zones 2, 6 or establishing joints or segments.

In combination with one or more of the aforementioned embodiments it is possible to add different elements to the concrete to obtain a suitable texture for casting or to obtain a kind of tensile reinforcement.

Such elements can be ropes, wires, plates, meshes, fibres, fabrics, rods or bars of suitable materials such as steel, carbon fibres, glass, polypropylene fibres or products of plastic, metals or organic fibres.

It is obvious that other suitable materials can be used and the invention is not limited to the use of the elements mentioned above.

The invention claimed is:

1. A light-weight load-bearing structure, suitable for being included at least in building roofs and comprising an upper concrete part and a lower concrete part, said upper concrete part being cast from higher-strength concrete upon the top surface of said lower concrete part, said lower concrete part being cast of less strong concrete, said top surface including portions defining highs with a low between said highs, said upper part forming compression arches by having a cross-section increasing from said highs towards said lows.

2. The structure of claim 1, said structure having a plurality of said highs and lows between said highs, to define a plurality of said compression arches in extension of each other.

3. The structure of claim 1, wherein said less strong concrete is light aggregate concrete.

4. The structure of claim 1, said higher-strength upper concrete part having a flat or essentially flat upper surface.

5. The structure of claim 1, said higher-strength upper concrete part having a tendency to spall at temperatures reaching 374° C.

6. The structure of claim 1, said higher-strength concrete being 3-5 times heavier than said less strong concrete.

7. The structure of claim 1, said higher-strength concrete being 3-10 times stronger than said less strong concrete.

8. The structure of claim 1, said cross-section increasing uniformly, from said highs to said lows.

9. A method of making a light-weight load-bearing structure, said method comprising the steps of:

providing a mold;

preparing a first type of concrete;

casting, using said mold and said first type of concrete, a lower concrete part having a top surface that includes portions defining highs with a low between said highs;

preparing a higher-strength type concrete stronger than said first type concrete; and using said lower concrete part as a second mold to complete said structure by applying said higher-strength type concrete upon said top surface to cast an upper part having a cross-section increasing from said highs towards said lows.

10. The method according to claim 9, said higher-strength type concrete upper part having a tendency to spall at temperatures reaching 374° C.

11. The method of claim 9, said higher-strength type concrete being 3-5 times heavier than said first type of concrete.

12. The method of claim 9, said higher-strength type concrete being 3-10 times stronger than said first type of concrete.

13. The method of claim 9, said cross-section increasing uniformly from said highs to said lows.

* * * * *